US009475095B2

(12) United States Patent
Jones et al.

(10) Patent No.: US 9,475,095 B2
(45) Date of Patent: Oct. 25, 2016

(54) SHAKER WITH AUTOMATIC MOTION

(71) Applicant: M-I L.L.C., Houston, TX (US)

(72) Inventors: Bradley Jones, Crestview Hills, KY (US); Benjamin Lanning Holton, Cincinnati, OH (US); Eric Cady, Florence, KY (US); Mark R. Jolly, Raleigh, NC (US); Jonathan M. Owens, Chapel Hill, NC (US); Askari Badre-Alam, Cary, NC (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 14/438,541

(22) PCT Filed: Oct. 28, 2013

(86) PCT No.: PCT/US2013/067088

§ 371 (c)(1),
(2) Date: Apr. 24, 2015

(87) PCT Pub. No.: WO2014/066893

PCT Pub. Date: May 1, 2014

(65) Prior Publication Data

US 2015/0283581 A1 Oct. 8, 2015

Related U.S. Application Data

(60) Provisional application No. 61/719,213, filed on Oct. 26, 2012.

(51) Int. Cl.
*B07B 1/42* (2006.01)
*B07B 1/28* (2006.01)

(52) U.S. Cl.
CPC ..... *B07B 1/42* (2013.01); *B07B 1/284* (2013.01); *B07B 2201/04* (2013.01)

(58) Field of Classification Search
CPC ..... B07B 1/42; B07B 1/284
USPC ..... 209/369
See application file for complete search history.

(56) References Cited

U.S. PATENT DOCUMENTS 5,265,730 A * 11/1993 Norris ..... B07B 1/42 198/770
8,596,463 B2 * 12/2013 Burkhard ..... B06B 1/161 209/235
2004/0099582 A1 * 5/2004 Largent ..... B01D 33/0307 209/667
2011/0060469 A1 3/2011 Burkhard et al.
2011/0114542 A1 * 5/2011 Carr ..... B07B 1/42 209/235

FOREIGN PATENT DOCUMENTS

KR 1020080058076 A 6/2008

OTHER PUBLICATIONS

International Search Report and Written Opinion issued in related PCT application PCT/US2013/067088 on Jan. 16, 2014, 12 pages.
Canadian Office Action issue in related Canadian Application Serial No. 2,889,626 on Mar. 17, 2016, 3 pages.

* cited by examiner

*Primary Examiner* — Terrell Matthews
(74) *Attorney, Agent, or Firm* — David J. Smith

(57) ABSTRACT

A method of controlling the vibration of a vibratory separator, the method including providing a vibratory separator having a frame and a plurality of force generators coupled to the frame and a control unit operatively connected to each of the plurality of force generators, and independently controlling each of the plurality of force generators. Independently controlling each of the plurality of force generators controls a motion profile of the vibratory separator.

20 Claims, 9 Drawing Sheets

SHAKER WITH AUTOMATIC MOTION

BACKGROUND

Oilfield drilling fluid, often called "mud," serves multiple purposes in the industry. Among its many functions, the drilling mud acts as a lubricant to cool rotary drill bits and facilitate faster cutting rates. The mud may be mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Drilling mud weight may be reported in "pounds," short for pounds per gallon. Increasing the amount of weighting agent solute dissolved in the mud base may create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and re-pumped down through nozzles of the drill bit, the cutting particulates need to be removed.

Apparatuses in use today to remove cuttings and other solid particulates from drilling fluid are commonly referred to in the industry as shale shakers or vibratory separators. A shaker is a vibrating sieve-like table or screening deck upon which returning solids laden drilling fluid is deposited, and through which drilling fluid, that has been separated from much of the solids, emerges from the shaker. The shaker may be an angled table with a perforated filter screen bottom. Returning drilling fluid is deposited at a feed end of the shaker. As the drilling fluid travels down length of the vibrating table, the fluid falls through the perforations to a reservoir below leaving the solid particulate material behind.

Such shakers may implement one or two electric motors mounted thereon, in which the motors are positioned in close proximity such that inertial or mechanical phasing may be achieved. Other shakers implement a motor speed controller on the motors of the shaker in order to raise or lower the frequency of the vibration of the motors. The vibrating action of the shaker table conveys solid particles left behind until they fall off the discharge end of the shaker table. The above described apparatus is illustrative of one type of shaker known to those of ordinary skill in the art. In alternative shakers, the top edge of the shaker is relatively closer to the ground than the lower end. In such shakers, the angle of inclination requires the movement of particulates in an upward direction. In other shakers, the table may not be angled, thus the vibrating action of the shaker alone may enable particle/fluid separation. Regardless, table inclination and/or design variations of existing shakers should not be considered a limitation of the present disclosure.

DETAILED DESCRIPTION

Figure 1A:
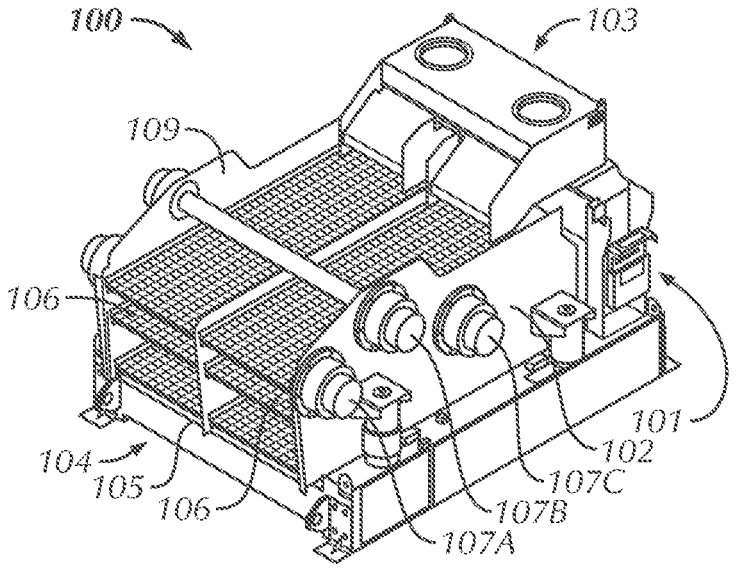
FIG. 1A is a perspective view of a vibratory separator having a plurality of force generators coupled thereto according to embodiments disclosed herein.

The following is directed to various exemplary embodiments of the disclosure. According to one or more embodiments disclosed herein, the following disclosure is directed to a vibratory separator and a method of controlling the vibration of a vibratory separator, which includes instantaneously and independently controlling each of a plurality of force generators coupled to the vibratory separator. Instantaneously and independently controlling each of the plurality of force generators coupled to the vibratory separator may include independently controlling a direction or rotation, a speed or frequency of rotation, a phase position, and, as a result, an overall force output of each of the plurality of force generators. In one or more embodiments, an overall force output of each of the plurality of force generators may be controlled such that a sum of the overall force output of each of the plurality of force generators, e.g., a sum of force vectors from each of the plurality of force generators, may be considered a net force output by the plurality of force generators and may result in the control of a motion profile of a vibratory separator as a whole. In other words, instantaneously and independently controlling a motion profile of a vibratory separator may include controlling the direction or rotation, the speed or frequency of rotation, and the phase position of each of the plurality of force generators by a user. The user may independently control each of the parameters of the motion profile of the vibratory separator, which may include, at least, a frequency, an amplitude, a phase or shape, and an angle of attack of the vibratory separator. Further, as a result, a user may have increased freedom in the position of each of the force generators on the vibratory separator. For example, in one or more embodiments, force generators may be coupled to opposite ends of a vibratory separator, without regard for the rigidity or flexibility of the connection between the force generators, and may still be able to achieve a desired motion profile of the vibratory separator. Although one or more of these embodiments may be preferred, the embodiments disclosed should not be interpreted, or otherwise used, as limiting the scope of the disclosure, including the claims. In addition, those having ordinary skill in the art will appreciate that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As those having ordinary skill in the art will appreciate, different persons may refer to the same feature or component by different names. This document does not intend to distinguish between components or features that differ in name but not function. The figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first component is coupled to a second component, that connection may be through a direct connection, or through an indirect connection via other components, devices, and connections. Further, as used herein, the terms "independently" and "individually" may be used interchangeably, and the terms "manipulate" and "control" may also be used interchangeably.

Generally, embodiments disclosed herein relate to apparatuses and methods for separating solids from liquids. Specifically, embodiments disclosed herein relate to apparatuses and methods for separating solids from liquids using dual motion profiles on vibratory separators. More specifically still, embodiments disclosed herein relate to apparatuses and methods for producing controllable motion or vibration of vibratory separators by individually manipulating a plurality of force generators.

Vibratory separators may be designed to produce a specific type of motion such as, for example, linear, circular, unbalanced elliptical, or balanced elliptical motion. The type of motion may be dictated by the placement of force generators relative to the body of the vibratory separator. As such, in such vibratory separators, the shape of the motion is changed by physically altering the configuration/placement of the force generators. Vibratory separators capable of generating a single type of motion may include one or two force generators positioned at a specific location on the body of the vibratory separator. For example, round motion may be generated by a single force generator located proximate to the center of gravity of the vibratory separator. Further, linear motion may be generated through the use of two counter-rotating force generators disposed on the vibratory separator. Multi-direction or elliptical motion may be generated with one force generator disposed at a select distance from the center of gravity of the vibratory separator.

More complex motion types, such as balanced elliptical motion, may be employed through the use of two counter-rotating force generators disposed on the vibratory separator. Furthermore, certain vibratory separators may be designed to allow for the switching of motion types, such as the switching between linear and balanced elliptical motion. Such dual motion vibratory separators may use three or more force generators, in which two force generators may be used to produce a first motion type, while the additional force generator or generators may be used to switch to a third motion type. In alternate designs, dual-motion vibratory separators may be designed using two force generators, in which a physical alternation of the placement of one of the force generators may allow for a change in the motion type or shape.

Embodiments of the present disclosure allow for controllable, fine-tuned manipulation of the motion of a vibratory separator through the use of a plurality of force generators and a control unit. Specifically, in one or more embodiments, the motion of the vibratory separator may be controlled by individually manipulating each of the plurality of force generators. By individually manipulating each of the plurality of force generators, the collective motion of the vibratory separator may be fine-tuned and may be controlled at a high degree.

For example, in one or more embodiments, the ability to individually manipulate each of the plurality of force generators may include the ability to individually control the direction of rotation, the speed or frequency of rotation, the phase of rotation, and the amount of force of each force generator. In other words, the ability to individually manipulate each of the plurality of force generators may include controlling relative instantaneous phasing between force generators.

In one or more embodiments, controlling the phase of rotation of the plurality of force generators may include controlling a shaft position of a rotatable eccentric weight (described below) of each of the plurality of force generators. In one or more embodiments, the shaft position of one of the plurality of force generators may include the rotational position of the rotatable eccentric weight of the force generator. One or more embodiments of the present disclosure may allow for instantaneous, real-time control of the plurality of force generators, which may include controlling the phase of rotation of the plurality of force generators. For example, the plurality of force generators may be servomotors, and the shaft position of each rotatable eccentric weight of one or more of the plurality of force generators, i.e., the phase of rotation of the plurality of force generators, may be known and controlled instantaneously in real-time.

In one or more embodiments, the phase of rotation of the plurality of force generators may be synchronized or desynchronized instantaneously in real-time. A plurality of force generators that have a synchronized phase of rotation each may include a rotatable eccentric weight in which each of the rotatable eccentric weights constantly share a common rotational position during rotation. A plurality of force generators that have a desynchronized phase of rotation may not have rotatable eccentric weights that constantly share a common rotational position during rotation. However, those having ordinary skill will appreciate that a plurality of force generators that have a desynchronized phase of rotation may include one or more groups of force generators within the plurality that may have a synchronized phase of rotation. For example, the plurality of force generators may include eight force generators, in which a first group of four force generators are controlled such that the first group has a synchronized phase of rotation. Further, for example, a second group of four force generators are controlled such that the second group has a synchronized phase of rotation that is different from that of the first group. As such, the plurality of eight force generators may be said to have a desynchronized phase of rotation even though the first group of force generators has a synchronized phase of rotation and the second group of force generators has a different synchronized phase of rotation. According to embodiments disclosed herein, the direction of rotation, the speed or frequency of rotation, the phase of rotation, and the amount of force of each force generator may be independently and instantaneously changed and controlled according to the desires of a user.

Those of ordinary skill in the art will appreciate that modulating the type of motion depending on operational parameters of the drilling operations, such as drill cutting flow rate, may allow for a more efficient processing of drilled solids, reduced fluid losses with discarded cuttings, less downtime due to adjustments of the force generators, and less downtime due to changing of screens in the vibratory separator. While specific embodiments of the present disclosure will be discussed in detail below, generally, embodiments disclosed herein may allow for control of the motion of a vibratory separator by individually controlling a plurality of force generators of the vibratory separator.

According to one aspect of embodiments disclosed herein, there is provided a vibratory separator having a frame, a plurality of force generators coupled to the frame, and a control unit operatively connected to each of the plurality of force generators. In one or more embodiments, the frame may include a side wall on which at least one of the plurality of force generators is coupled. In one or more embodiments, the frame may include a central wall on which at least one of the plurality of force generators is coupled.

Figure 1B:
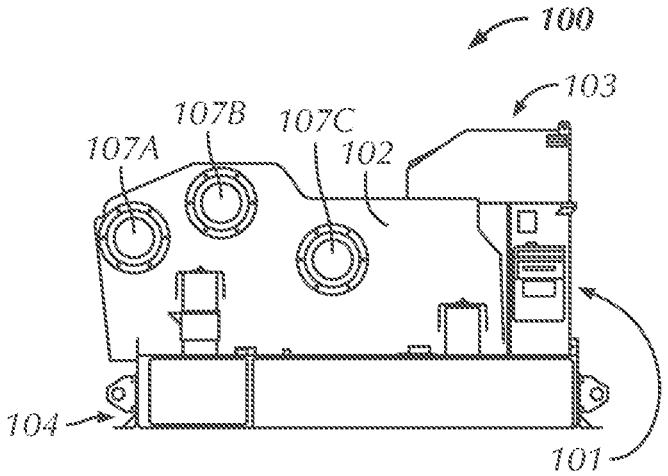
FIG. 1B is a side view of the vibratory separator of FIG. 1A.

Referring to FIGS. 1A and 1B, FIG. 1A is a perspective view of a vibratory separator 100 having a plurality of force generators 107A, 107B, and 107C coupled thereto, in accordance with embodiments disclosed herein, while FIG. 1B is a side view of the vibratory separator 100. In one or more embodiments, the vibratory separator 100 includes a frame 101, a side wall 102, a second side wall 109, an inlet end 103, and a discharge end 104. In one or more embodiments, the vibratory separator 100 may also include a basket 105 that is configured to hold at least one screen assembly 106. Those having ordinary skill in the art will appreciate that any number of screen assemblies 106 may be included in the vibratory separator 100. In one or more embodiments, both the side wall 102 and the basket 105 may be considered to be part of the frame 101. Operationally, as drilling material enters the vibratory separator 100 through the inlet end 103, the drilling material may be moved along the screen assembly 106 by a vibratory motion. As the screen assembly 106 may vibrates, residual drilling fluid and small particulate matter, i.e., particulate matter smaller than the mesh size of the screen assembly, may fall through the screen assembly 106 for collection and recycling, while larger solids are retained on the screen assembly 106 and discharged from the discharge end 104.

In one or more embodiments, this vibratory motion of the screen assembly 106 may be supplied by the plurality of force generators 107A, 107B, and 107C. In one or more embodiments, the vibration of each of the plurality of force generators 107A, 107B, and 107C may cause the frame 101 of the vibratory separator 100 to vibrate, which may cause the basket 105 and the screen 106 to vibrate. As shown, the plurality of force generators 107A, 107B, and 107C are coupled to the side wall 102. The force generators 107A, 107B, and 107C may be coupled or attached to the vibratory separator 100 in various manners and in various locations as will be appreciated by those having ordinary skill in the art, such as on the frame 101, the basket 105 and/or at a location above the screen assembly 106, such as on a bar (not numbered) shown in FIG. 1A above the screen assembly 106. The force generators 107A, 107B, and 107C are not limited to being substantially similar to each other. For example, in one or more embodiments, the force generators 107A, 107B, and 107C may vary in size as well as effective strength, e.g., the amount of possible force output.

As will be discussed below, other force generators (not shown) that may be substantially similar to the plurality of force generators 107A, 107B, and 107C may be coupled at other locations on the vibratory separator 100. For example, in one or more embodiments, substantially similar force generators may be coupled to a second side wall 109 opposite to the side wall 102. However, in one or more embodiments, the other force generators may not be limited to being substantially similar to force generators 107A, 107B, and 107C. For example, in one or more embodiments, the other force generators may vary in size, number, and effective strength, e.g., the amount of possible force output, when compared to the force generators 107A, 107B, and 107C. Further, in one or more embodiments, the other force generators may be coupled to different locations on the second side wall 109 when compared to locations of the force the force generators 107A, 107B, and 107C coupled to the side wall 102.

Further, in one or more embodiments, one or more substantially similar force generators may be coupled to the basket 105 and/or directly coupled to a portion of one or more screen assemblies 106 in order to achieve vibration of each screen assembly 106.

In one or more embodiments, the plurality of force generators 107A, 107B, and 107C may be driven by rotary motors (not shown) having shafts (not shown) coupled to unbalanced or eccentric weights (not shown) attached to opposite ends of the shafts. In other words, in one or more embodiments, each of the plurality of force generators may include a rotatable eccentric weight, as will be discussed below.

As will be discussed below, in one or more embodiments, a control unit (not shown) may be operatively connected to each of the plurality of force generators 107A, 107B, and 107C. In one or more embodiments, the control unit may be configured to independently control each of the plurality of force generators 107A, 107B, and 107C. Those having ordinary skill in the art will appreciate that the phrase "operatively connected" may not require that the plurality of force generators 107A, 107B, and 107C be physically connected to the control unit via a physical connection, e.g., a wire. For example, in one or more embodiments, the control unit may be wirelessly connected to one or more of the plurality of force generators 107A, 107B, and 107C such that the control unit may communicate with and control one or more of the plurality of force generators 107A, 107B, and 107C via one or more wireless signals and without the use of a physical connection between the control unit and each of the plurality of force generators 107A, 107B, and 107C. Furthermore, the phrase "operatively connected" may not require a direct connection. In other words, other components, devices, connections, etc. may be provided between the plurality of force generators 107A, 107B, and 107C and the control unit.

In one or more embodiments, the control unit may be configured to independently control the rotatable eccentric weight in each of the plurality of force generators 107A, 107B, and 107C. In one or more embodiments, the control unit may be configured to independently control a rate of rotation of the rotatable eccentric weight in each of the plurality of force generators 107A, 107B, and 107C. Further, in one or more embodiments, the control unit may be configured to independently control a direction of rotation of the rotatable eccentric weight in each of the plurality of force generators 107A, 107B, and 107C.

For example, the control unit may control a force generator 107A and cause the force generator 107A to rotate in a first direction at a first rate of rotation, and the control unit may simultaneously control force generator 107B and cause the force generator 107B to rotate in a second direction at a second rate of rotation. Further, in one or more embodiments, the control unit may also simultaneously control force generator 107C and cause the force generator 107C to rotate in the first direction at a third rate of rotation. In one or more embodiments, a rotation of a force generator may refer to a rotation of a rotatable eccentric weight of the force generator, as will be discussed below. While this example describes the direction of rotation of the force generators 107A, 107B, and 107C as a first direction, one having ordinary skill in the art will appreciate that the control unit may simultaneously control each force generator 107A, 107B, and 107C, such that the direction of rotation and/or the rate of rotation of each force generator may be independently controlled. Thus, the direction of rotation and/or the rate of rotation of each force generator 107A, 107B, and 107C may be the same or different than the other force generators.

Although only three force generators 107A, 107B, and 107C are labeled on the vibratory separator 100, those having ordinary skill in the art will appreciate that more or less than three force generators may used. For example, in one or more embodiments, one, two, three, four, five, six, seven, eight, nine, ten, eleven, twelve, or more force generators may be coupled to any part of the vibratory separator 100. In one or more embodiments, the number of force generators as well as the position on the vibratory separator of each force generator may be specific to the type of motion profile a user may be trying to achieve. As such, those having ordinary skill in the art will appreciate that, according to embodiments described herein, any number of force generators may be placed on any location or portion of the vibratory separator 100, as different motion profiles may be achieved using different numbers of force generators positioned at different locations on the vibratory separator 100. As such, the positioning of the plurality of force generators on the vibratory separator may not necessarily be symmetrical, and a number of force generators coupled to one side of the vibratory separator may not necessarily equal a number of force generators coupled to another side of the vibratory separator.

For example, in FIGS. 2A-2B, 3A-3B, 4A-4B, and 5A-5B, vibratory separators, in accordance with embodiments disclosed herein, having a plurality of force generators coupled thereto at different locations are shown.

Figure 2A:
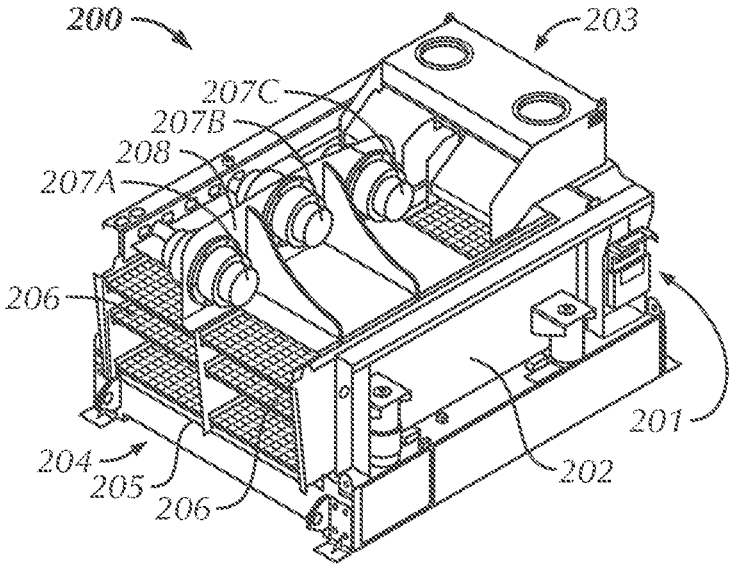
FIG. 2A is a perspective view of a vibratory separator having a plurality of force generators coupled thereto according to embodiments disclosed herein.
Figure 2B:
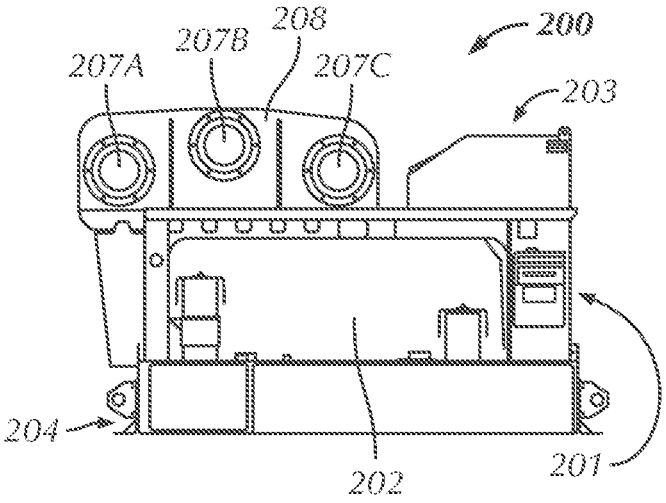
FIG. 2B is a side view of the vibratory separator of FIG. 2A.

Referring to FIGS. 2A and 2B, FIG. 2A is a perspective view of a vibratory separator 200 having a plurality of force generators 207A, 207B, and 207C coupled thereto, in accordance with embodiments disclosed herein, while FIG. 2B is a side view of the vibratory separator 200. While FIGS. 2A and 2B show three force generators, one of ordinary skill in the art will appreciate that less than three or more than three force generators may be used in accordance with embodiments disclosed herein. In one or more embodiments, the vibratory separator 200 includes a frame 201, a side wall 202, a central wall 208, a second side wall (not shown) opposite to the side wall 202, an inlet end 203, and a discharge end 204. In one or more embodiments, the vibratory separator 200 may also include a basket 205 that is configured to hold at least one screen assembly 206. In one or more embodiments, each of the side wall 202, the central wall 208, the second side wall, and the basket 205 may be considered to be part of the frame 201.

As discussed above, as the screen assembly 206 vibrates, residual drilling fluid and particulate matter may fall through the screen assembly 206 for collection and recycling, while larger solids are retained on the screen assembly 206 and discharged from the discharge end 204. In one or more embodiments, this vibratory motion of the screen assembly 206 may be supplied by the plurality of force generators 207A, 207B, and 207C. As shown, the plurality of force generators 207A, 207B, and 207C are coupled on one side of the central wall 208. In one or more embodiments, the central wall 208 may extend in a substantially vertical direction, i.e., in a direction in which the side wall 202 extends. In one or more embodiments, the central wall 208 may divide the basket 25 into two parts and may provide additional support to the frame 201 and for the screen assembly 206. In one or more embodiments, the central wall 208 may substantially bisect the basket 205.

Further, as discussed above, in one or more embodiments, other force generators that may be substantially similar to the plurality of force generators 207A, 207B, and 207C may be coupled at other locations on the vibratory separator 200. For example, in one or more embodiments, substantially similar force generators may be coupled to the central wall 208 on an opposite side of the central wall 208 and/or on the second side wall opposite to the side wall 202. However, in one or more embodiments, the other force generators may not be limited to being substantially similar to force generators 207A, 207B, and 207C, as discussed above regarding the force generators 107A, 107B, and 107C of FIGS. 1A and 1B. Further, in one or more embodiments, the force generators 207A, 207B, and 207C are not limited to being substantially similar to each other, as discussed above.

Figure 3A:
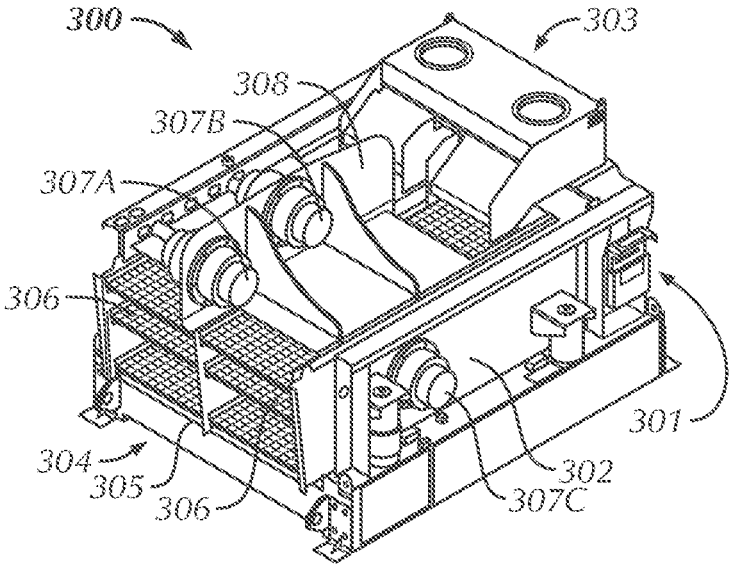
FIG. 3A is a perspective view of a vibratory separator having a plurality of force generators coupled thereto according to embodiments disclosed herein.
Figure 3B:
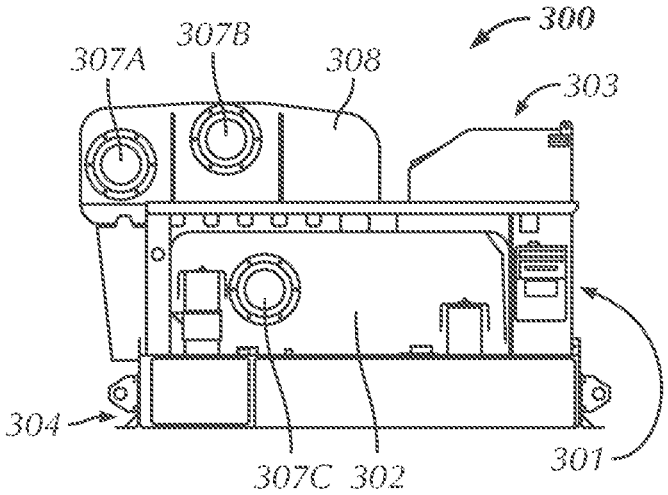
FIG. 3B is a side view of the vibratory separator of FIG. 3A.

Referring to FIGS. 3A and 3B, FIG. 3A is a perspective view of a vibratory separator 300 having a plurality of force generators 307A, 307B, and 307C coupled thereto, in accordance with embodiments disclosed herein, while FIG. 3B is a side view of the vibratory separator 300. In one or more embodiments, the vibratory separator 300 includes a frame 301, a side wall 302, a second side wall (not shown), a central wall 308, an inlet end 303, and a discharge end 304. In one or more embodiments, the vibratory separator 300 may also include a basket 305 that is configured to hold at least one screen assembly 306. In one or more embodiments, each of the side wall 302, the central wall 308, the second side wall, and the basket 305 may be considered to be part of the frame 301.

As discussed above, as the screen assembly 306 vibrates, residual drilling fluid and particulate matter may fall through the screen assembly 306 for collection and recycling, while larger solids are retained on the screen assembly 306 and discharged from the discharge end 304. In one or more embodiments, this vibratory motion of the screen assembly 306 may be supplied by the plurality of force generators 307A, 307B, and 307C. As shown, the force generators 307A and 307B are coupled on one side of the central wall 308. Further, as shown, the force generator 307C is coupled to a front portion, i.e., proximate the discharge end 304, of the side wall 302.

Further, as discussed above, in one or more embodiments, other force generators (not shown) that may be substantially similar to the plurality of force generators 307A, 307B, and 307C may be coupled at other locations on the vibratory separator 300. For example, in one or more embodiments, other force generators may be coupled to the central wall 308 on an opposite side of the central wall 308 and/or on the second side wall opposite to the side wall 302. However, in one or more embodiments, the other force generators may not be limited to being substantially similar to force generators 307A, 307B, and 307C, as discussed above regarding the force generators 107A, 107B, and 107C of FIGS. 1A and 1B. Further, in one or more embodiments, the force generators 307A, 307B, and 307C are not limited to being substantially similar to each other, as discussed above.

Figure 4A:
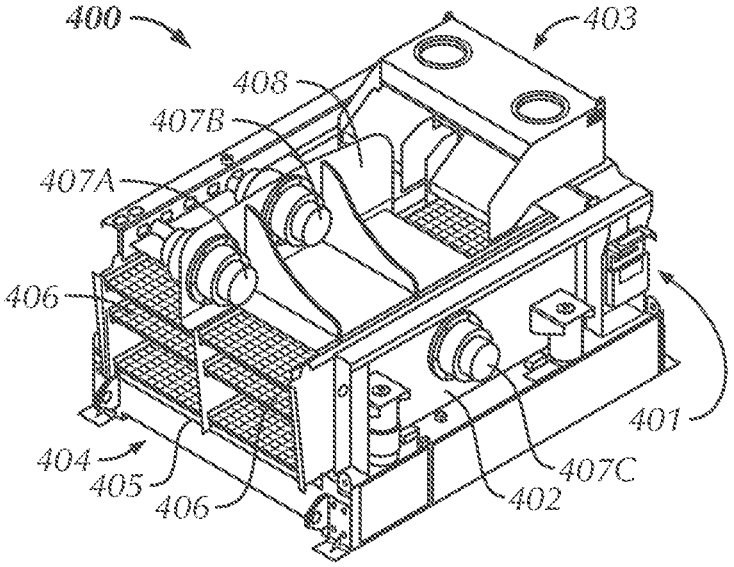
FIG. 4A is a perspective view of a vibratory separator having a plurality of force generators coupled thereto according to embodiments disclosed herein.
Figure 4B:
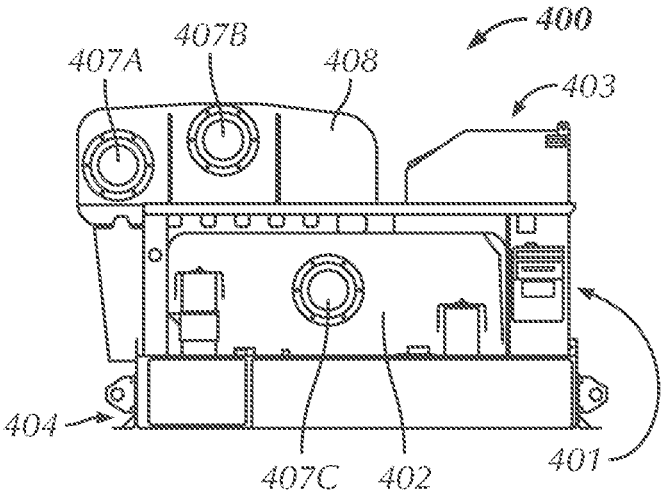
FIG. 4B is a side view of the vibratory separator of FIG. 4A.

Referring to FIGS. 4A and 4B, FIG. 4A is a perspective view of a vibratory separator 400 having a plurality of force generators 407A, 407B, and 407C coupled thereto, in accordance with embodiments disclosed herein, while FIG. 4B is a side view of the vibratory separator 400. In one or more embodiments, the vibratory separator 400 includes a frame 401, a side wall 402, a central wall 408, a second side wall (not shown), an inlet end 403, and a discharge end 404. In one or more embodiments, the vibratory separator 400 may also include a basket 405 that is configured to hold at least one screen assembly 406. In one or more embodiments, each of the side wall 402, the central wall 408, the second side wall, and the basket 405 may be considered to be part of the frame 401.

As discussed above, as the screen assembly 406 vibrates, residual drilling fluid and particulate matter may fall through the screen assembly 406 for collection and recycling, while larger solids are discharged from the discharge end 404. In one or more embodiments, this vibratory motion of the screen assembly 406 may be supplied by the plurality of force generators 407A, 407B, and 407C. As shown, the force generators 407A and 407B are coupled on one side of the central wall 408. Further, as shown, the force generator 407C is coupled to a central portion, i.e., between the inlet end 403 and the discharge end 404, of the side wall 402.

Further, as discussed above, in one or more embodiments, other force generators that may be substantially similar to the plurality of force generators 407A, 407B, and 407C may be coupled at other locations on the vibratory separator 400. For example, in one or more embodiments, substantially similar force generators may be coupled to the central wall 408 on an opposite side of the central wall 408 and/or on the second side wall opposite to the side wall 402. However, in one or more embodiments, the other force generators may not be limited to being substantially similar to force generators 407A, 407B, and 407C, as discussed above regarding the force generators 107A, 107B, and 107C of FIGS. 1A and 1B. Further, in one or more embodiments, the force generators 407A, 407B, and 407C are not limited to being substantially similar to each other, as discussed above.

Figure 5A:
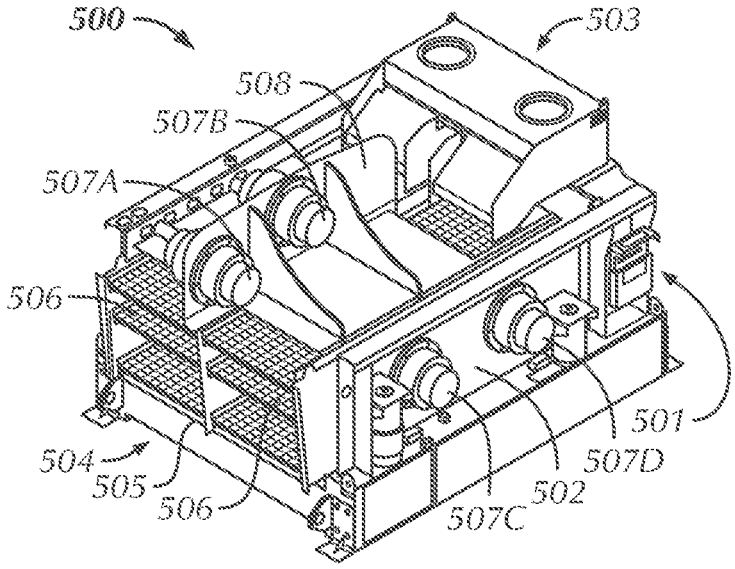
FIG. 5A is a perspective view of a vibratory separator having a plurality of force generators coupled thereto according to embodiments disclosed herein.
Figure 5B:
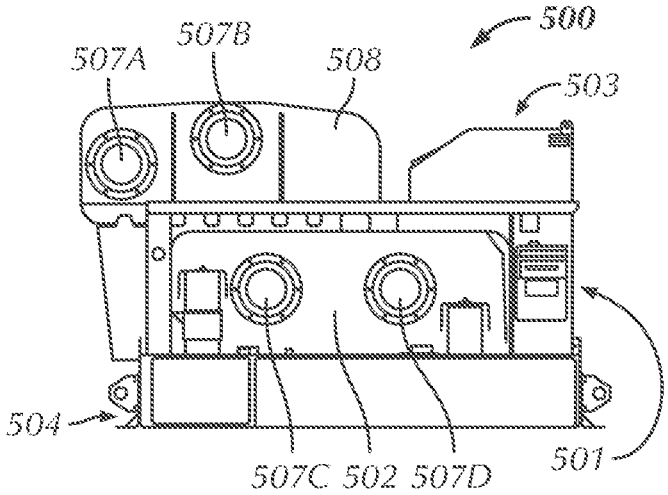
FIG. 5B is a side view of the vibratory separator of FIG. 5A.

Referring to FIGS. 5A and 5B, FIG. 5A is a perspective view of a vibratory separator 500 having a plurality of force generators 507A, 507B, 507C and 507D coupled thereto, in accordance with embodiments disclosed herein, while FIG. 5B is a side view of the vibratory separator 500. In one or more embodiments, the vibratory separator 500 includes a frame 501, a side wall 502, a central wall 508, a second side wall (not shown), an inlet end 503, and a discharge end 504. In one or more embodiments, the vibratory separator 500 may also include a basket 505 that is configured to hold at least one screen assembly 506. In one or more embodiments, each of the side wall 502, the central wall 508, the second side wall, and the basket 505 may be considered to be part of the frame 501.

As discussed above, as the screen assembly 506 vibrates, residual drilling fluid and particulate matter may fall through the screen assembly 506 for collection and recycling, while larger solids are retained on the screen assembly 506 and discharged from the discharge end 504. In one or more embodiments, this vibratory motion of the screen assembly 506 may be supplied by the plurality of force generators 507A, 507B, 507C, and 507D. As shown, the force generators 507A and 507B are coupled on one side of the central wall 508. Further, as shown, the force generators 507C and 507D are coupled to the side wall 502. The force generator 507 C may be coupled to the side wall 502 proximate the discharge end 504 while the force generator 507D may be coupled to the side wall 502 proximate the inlet end 503.

Further, as discussed above, in one or more embodiments, other force generators that may be substantially similar to the plurality of force generators 507A, 507B, 507C and 507D may be coupled at other locations on the vibratory separator 500. For example, in one or more embodiments, substantially similar force generators may be coupled to the central wall 508 on an opposite side of the central wall 508 and/or on the second side wall opposite to the side wall 502. However, in one or more embodiments, the other force generators may not be limited to being substantially similar to force generators 507A, 507B, 507C, and 507D, as discussed above regarding the force generators 107A, 107B, and 107C of FIGS. 1A and 1B. Further, in one or more embodiments, the force generators 507A, 507B, 507C, and 507D are not limited to being substantially similar to each other, as discussed above.

In one or more embodiments, each of the plurality of force generators may include a rotatable eccentric weight.

Figure 6A:
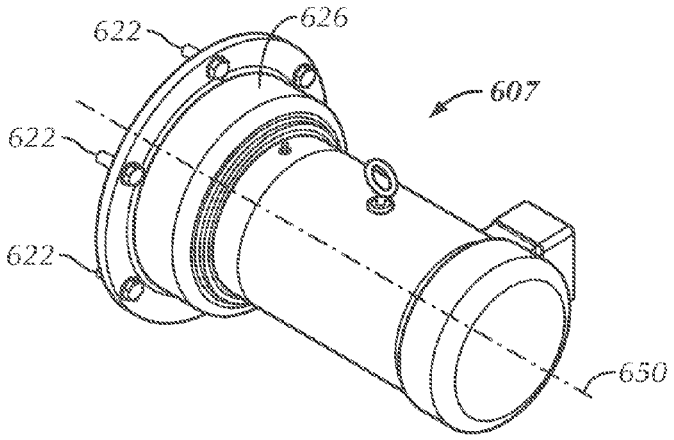
FIGS. 6A and 6B are perspective views of a force generator according to embodiments disclosed herein.
Figure 6B:
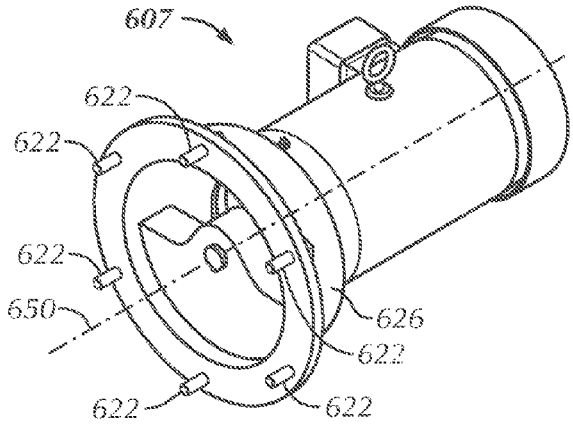
Figure 6C:
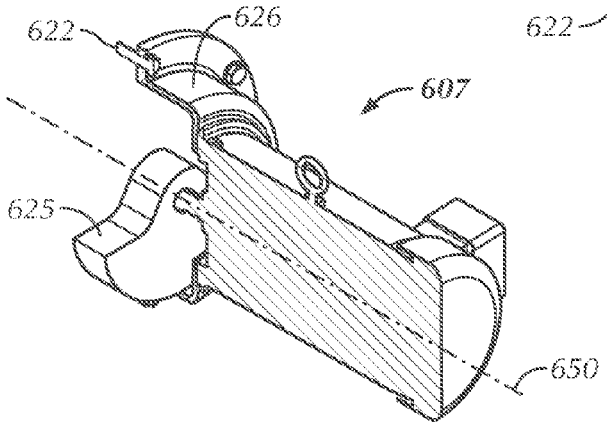
FIG. 6C is a cross-sectional view of the force generator of FIGS. 6A and 6B.

Referring now to FIGS. 6A-6C, FIGS. 6A and 6B are perspective views of a force generator 607 in accordance with embodiments disclosed herein, and FIG. 6C is a cross-sectional view of the force generator 607. In one or more embodiments, the force generator 607 may be a servo-vibrator. In one or more embodiments, the force generator 607 may include a rotatable eccentric weight 625. The rotatable eccentric weight 625 may be formed from any material known in the art and may be configured to rotate in either direction, i.e., either clockwise or counterclockwise about an axis 650. For example, the rotatable eccentric weight 625 may be formed from rubber, plastic, metal, or any combination thereof as well as from any other material known in the art.

In one or more embodiments, the rotatable eccentric weight 625 may cause the force generator 607 to be unbalanced. As such, in one or more embodiments, the rotation of the rotatable eccentric weight 625 may produce a centripetal force, which may cause the force generator 607 to move or vibrate. In one or more embodiments, the frequency, amplitude, phase or shape, and angle of attack of the motion of the force generator 607 may be governed by the rate of rotation and the direction of rotation of the rotatable eccentric weight 625 of the force generator 607. As such, the parameters of a motion profile of a structure, which may include the frequency, amplitude, phase or shape, and angle of attack of the motion of a structure, e.g. a vibratory separator, may be governed by the rate of rotation and the direction of rotation of a rotatable eccentric weight, e.g., the rotatable eccentric weight 625, of one or more force generators, e.g., the force generator 607.

In one or more embodiments, the force generator 607 may include a protective cover 626 configured to protect interior components of the force generator 607, such as the rotatable eccentric weight 625, from exterior influences such as physical impact. The protective cover 626 of the force generator 607 may be formed from any substantially rigid material. For example, the protective cover 626 of the force generator 607 may be formed from plastic or metal or any combination thereof as well as from any other substantially rigid material known in the art. Further, in one or more embodiments, the force generator 607 may include one or more engagement members 622. In one or more embodiments, the engagement members 622 may be used to couple the force generator 607 to a vibratory separator (not shown). For example, as discussed above, the force generator 607 may be coupled to various locations on a vibratory separator, which may be determined by a desired motion profile of the vibratory separator by a user. For example, in one or more embodiments, the force generator 607 may be coupled to a frame (not shown) of the vibratory separator, which may include side walls (not shown), a central wall (not shown), and/or a basket (not shown), as described above. Further, in one or more embodiments, the force generator 607 may be coupled directly to one or more screen assemblies (not shown).

In one or more embodiments, the engagement members 622 may be a threaded nut and washer engagement assembly. In one or more embodiments, threaded rods may be disposed through engagement openings formed in the protective cover 626 of the force generator. Once the threaded rods are disposed through the engagement openings of the protective cover 626 of the force generator, washers may be disposed over the threaded rods and the threaded nuts may be threaded onto the threaded rods, as shown in FIGS. 6A-6C. However, those having ordinary skill in the art will appreciate that the engagement members may not be limited to a threaded nut and washer engagement assembly for coupling the force generator 607 to a vibratory separator. The force generator 607 may be coupled to a vibratory separator by any means known in the art. For example, in one or more embodiments, the force generator 607 may be coupled by other mechanical fasteners known in the art or by bonding the force generator 607 to a portion of the vibratory separator without the use of a threaded nut and washer assembly.

As discussed above, in one or more embodiments, a control unit may be operatively connected to each of the plurality of force generators, in which the control unit may be configured to control each of the plurality of force generators independently.

Figure 7A:
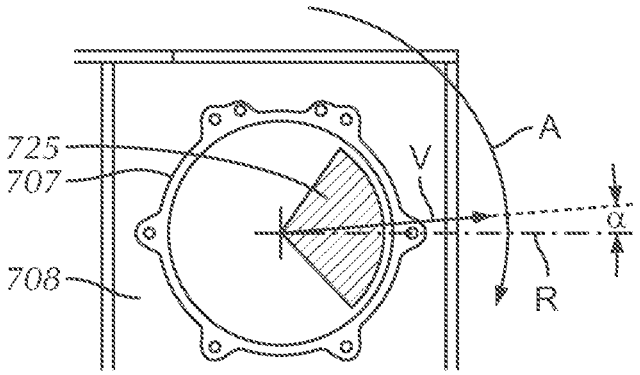
FIGS. 7A and 7B are cross-sectional views of a force generator having a rotatable eccentric weight according to embodiments disclosed herein.
Figure 7B:
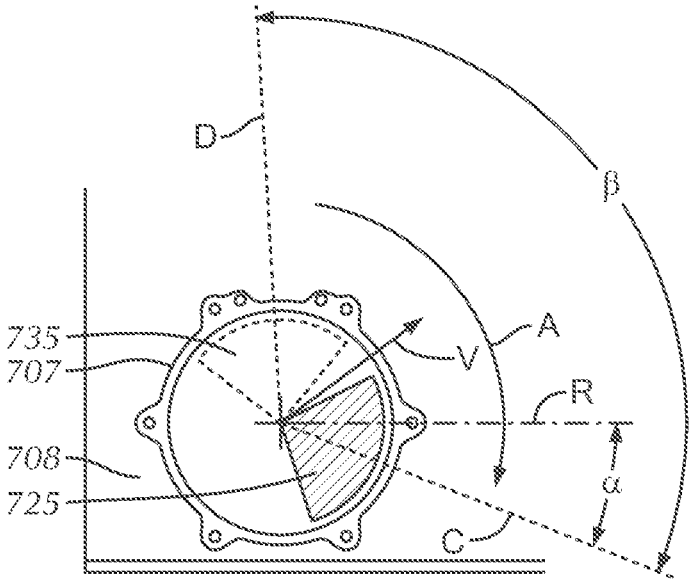
Figure 7C:
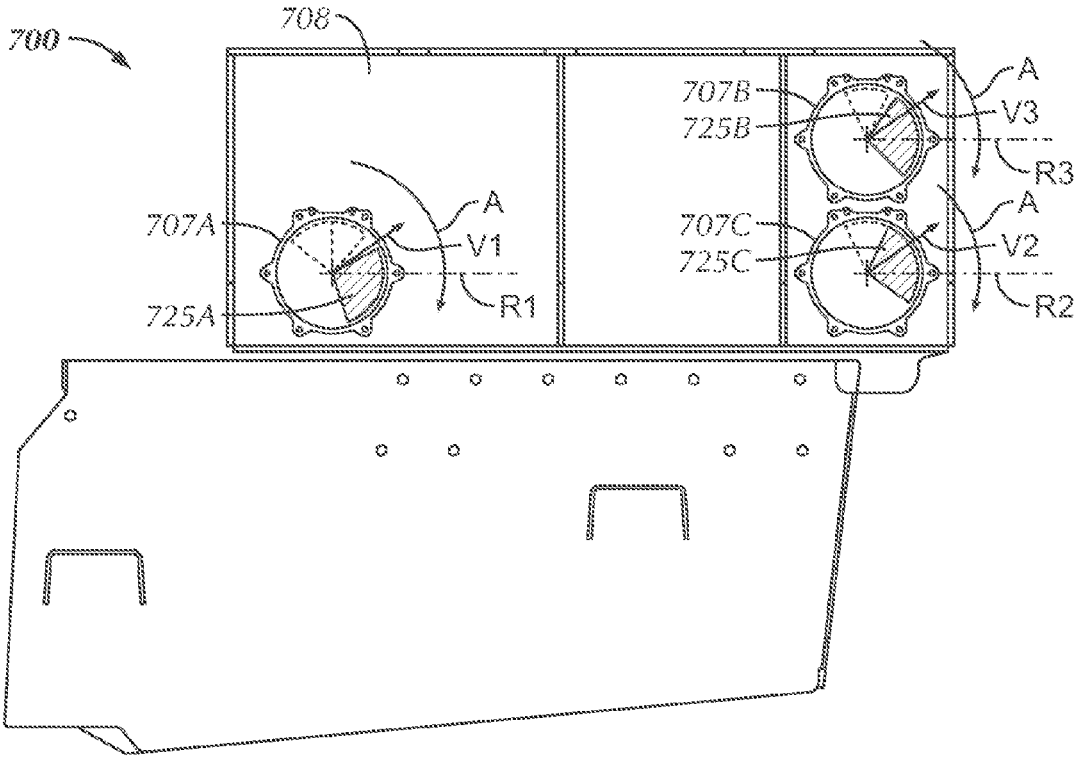
FIG. 7C is a schematic view of a vibratory separator having a plurality of force generators disposed thereon according to embodiments disclosed herein.

Referring to FIGS. 7A-7C, FIGS. 7A and 7B show cross-sectional views of a force generator 707 disposed on a central wall 708, the force generator 707 having a rotatable eccentric weight 725, in accordance with embodiments disclosed herein. FIG. 7C shows a schematic view of a vibratory separator 700 having a plurality of force generators 707A, 707B, and 707C disposed on the vibratory separator 700, in accordance with embodiments disclosed herein.

As discussed above, controlling the phase of rotation of the plurality of force generators may include controlling a shaft position of a rotatable eccentric weight of each of the plurality of force generators. In one or more embodiments, the shaft position of one of the plurality of force generators may include the rotational position of the rotatable eccentric weight of the force generator. One or more embodiments of the present disclosure may allow for instantaneous, real-time control of the plurality of force generators, which may include controlling the phase of rotation of the plurality of force generators.

As shown in FIGS. 7A and 7B, the phase of rotation of the force generator 707 is shown by the rotational position of the rotatable eccentric weight 725 of the force generator 707 relative to a reference axis R and a direction of rotation is shown by the arrow A. In one or more embodiments, the reference axis R may remain constant and stationary despite rotation of the rotatable eccentric weight 725 of the force generator 707. As shown in FIG. 7B, the rotational position of the rotatable eccentric weight 725 may be designated by an axis C, which may be directed to a center line of the rotatable eccentric weight 725 of the force generator 707. As such, as shown in FIGS. 7A and 7B, the phase of rotation of the force generator 707 is represented by the angle $\alpha$, which is the angle between the reference axis R and the rotational position of the rotatable eccentric weight 725 designated by the axis C. Further, a force output of the force generator 707 may be illustrated by a force vector V, which may result from the direction of rotation, the frequency of rotation, the phase of rotation, and the force of rotation the rotatable eccentric weight 725 of the force generator 707. As discussed above, because each of the direction of rotation, the frequency of rotation, the phase of rotation, and the force of rotation the rotatable eccentric weight 725 of the force generator 707 may be manipulated or controlled instantaneously in real time for each force generator, the force vector V of the force generator 707 may also be manipulated or controlled instantaneously in real-time.

Further, as shown in FIG. 7B, a second force generator (not shown) is disposed on an opposite side of the central wall 708, the second force generator having a rotatable eccentric weight 735, depicted by the dotted lines in FIG. 7B. A relative phase position between the force generator 707 and the second force generator is shown by the rotational position of the rotatable eccentric weight 725 of the force generator 707 relative to the rotational position of the rotatable eccentric weight 735 of the second force generator. In one or more embodiments, the rotational position of the rotatable eccentric weight 735 of the second force generator may be designated by an axis D, which may be directed to a center line of the rotatable eccentric weight 735 of the second force generator. As such, the relative phase position between the force generator 707 and the second force generator is represented by the angle $\beta$, which is the angle between the rotational position of the rotatable eccentric weight 725 designated by the axis C and the rotational position of the rotatable eccentric weight 735 designated by the axis D.

As discussed above, embodiments disclosed herein may allow for instantaneous relative phasing between force generators. As such, in one or more embodiments, the relative phasing between the force generator 707 and the second force generator, i.e., the rotational position of each of the rotatable eccentric weights 725 and 735 may be constantly and instantaneously controlled in real-time. In other words, the angle β between the rotatable eccentric weights 725 and 735 may be constantly and instantaneously controlled or adjusted in real-time. As such, instantaneous relative phasing between force generators may be achieved. Those having ordinary skill in the art will appreciate that instantaneous relative phasing may be achieved by a plurality of force generators that includes more than two force generators. In other words, according to embodiments described herein, instantaneous relative phasing may be achieved by a plurality of force generators, in which the plurality of force generators may include two, three, four, five, six, seven, eight, nine, ten, eleven, twelve, or more force generators.

Further, as discussed above, the phase of rotation of the plurality of force generators may be synchronized or desynchronized instantaneously in real-time. For example, in one or more embodiments, a plurality of force generators that have a synchronized phase of rotation each may include a rotatable eccentric weight in which each of the rotatable eccentric weights constantly share a common rotational position during rotation, i.e., the angle β is zero. In one or more embodiments, a plurality of force generators that have a desynchronized phase of rotation, the rotatable eccentric weight of each of the plurality of force generators may not constantly share a common rotational position during rotation, i.e., the angle β is non-zero. However, as discussed above, those having ordinary skill will appreciate that a plurality of force generators that have a desynchronized phase of rotation may include one or more groups of force generators within the plurality that may have a synchronized phase of rotation.

Referring to FIG. 7C, each of the force generators 707A, 707B, and 707C disposed on the central wall 708 of a vibratory shaker 700 may include rotatable eccentric weights 725A, 725B, and 725C, respectively. Further, each of the force generators 707A, 707B, and 707C may each have individual references axes R1, R2, and R3 defined thereon, respectively and the direction of rotation of each of the rotatable eccentric weights 725A, 725B, and 725C are shown by the arrows A. As discussed above, the reference axes R1, R2, and R3 may remain constant and stationary despite rotation of the rotatable eccentric weights 725A, 725B, and 725C of the force generators 707A, 707B, and 707C.

As shown, each of the force generators 707A, 707B, and 707C include different output force vectors V1, V2, and V3, respectively. As discussed above, the force vectors associated with each of the force generators may be manipulated and controlled by controlling the direction of rotation, the frequency of rotation, the phase of rotation, and/or the force of rotation the rotatable eccentric weights of each of the force generators 707A, 707B, and 707C. Further, as discussed above, each of the direction of rotation, the frequency of rotation, the phase of rotation, and the force of rotation the rotatable eccentric weights of each of the force generators 707A, 707B, and 707C may be manipulated or controlled instantaneously in real time, and, as a result, the resultant force vectors V1, V2, and V3 of the force generators 707A, 707B, and 707C may also be manipulated or controlled instantaneously in real-time. As a result, the overall output of the plurality of force generators 707A, 707B, and 707C may be represented by summing up the resultant force vectors V1, V2, and V3 of the force generators 707A, 707B, and 707C. In other words, by instantaneously controlling the resultant force vectors V1, V2, and V3 of each of the plurality of force generators 707A, 707B, and 707C, infinite control of each of the parameters of a motion profile of the vibratory separator 700 as a whole may be provided. In one or more embodiments, the parameters of a motion control profile of the vibratory separator 700 may include a frequency of motion or vibration of the vibratory separator 700, an amplitude of the motion or of the vibration of the vibratory separator 700, a phase or shape of the motion or vibration of the vibratory separator 700, and an angle of attack of the vibratory separator 700 based on the motion or vibration of the vibratory separator 700.

Figure 8:
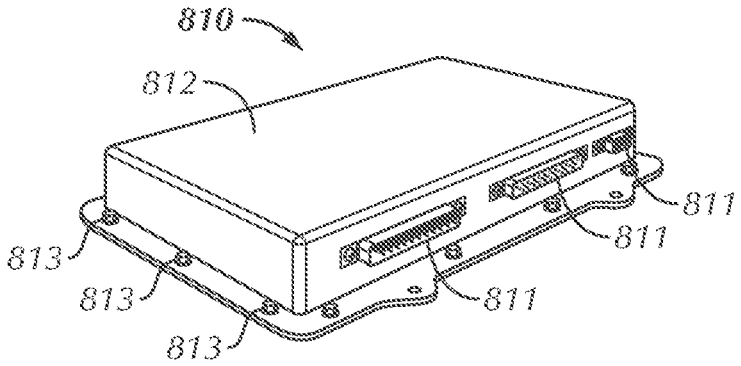
FIG. 8 is a perspective view of a control unit according to embodiments disclosed herein.

Referring to FIG. 8, a perspective view of a control unit 810, in accordance with embodiments disclosed herein, is shown. In one or more embodiments, the control unit 810 may include one or more inputs 811. In one or more embodiments, the inputs 811 may be used to operatively connect a plurality of force generators (not shown) to the control unit 810. Further, in one or more embodiments, the inputs 811 may be used to operatively connect a user interface (not shown) to the control unit 810, as will be discussed below. Furthermore, in one or more embodiments, the inputs 811 may be used to connect the control unit 810 to a power source (not shown).

In one or more embodiments, the control unit 810 may include a protective cover 812 configured to protect interior components of the control unit 810 from exterior influences such as physical impact. The protective cover 812 of the control unit 810 may be formed from any substantially rigid material. For example, the protective cover 812 of the control unit 810 may be formed from plastic or metal or any combination thereof as well as from any other substantially rigid material known in the art. Further, in one or more embodiments, the control unit 810 may include one or more engagement members 813. In one or more embodiments, the control unit 810 may be coupled to a frame (not shown) of a vibratory separator (not shown). Alternatively, in one or more embodiments, the control unit 810 may be coupled to a user module (not shown) that may be separate from the frame of the vibratory separator. As such, a user may control the plurality of force generators without directly engaging the frame of the vibratory separator.

As discussed above in FIGS. 6A and 6B with respect to the engagement members 622 for the protective cover 626 of the force generator 607, the engagement members 813 of the control unit 810 may be a threaded nut and washer engagement assembly. However, those having ordinary skill in the art will appreciate that the engagement members may not be limited to a threaded nut and washer engagement assembly for coupling the control unit 810 to the user module. The control unit 810 may be coupled to the user module by any means known in the art. For example, in one or more embodiments, the control unit 810 may be coupled by other mechanical fasteners known in the art or by bonding the control unit 810 to a user module without the use of a threaded nut and washer assembly.

Figure 9:
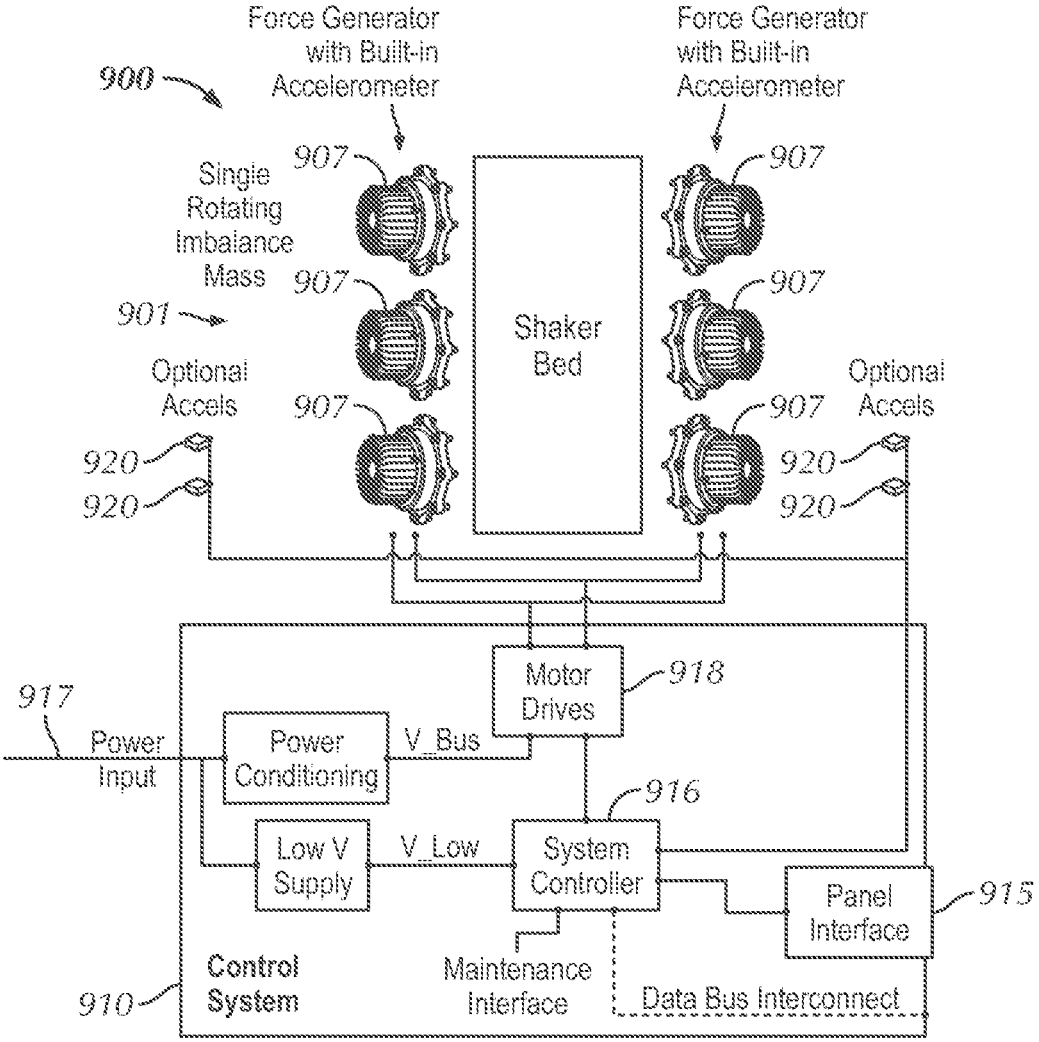
FIG. 9 is a schematic diagram of a vibratory separator having a control unit according to embodiments disclosed herein.

Referring to FIG. 9, a schematic diagram of a vibratory separator 900 having a control unit 910, in accordance with embodiments disclosed herein, is shown. In one or more embodiments, the vibratory separator 900 may include a frame 901 and a basket 905. As discussed above, in one or more embodiments, the basket 905 may be considered to be part of the frame 901. As such, in one or more embodiments, the motion or vibration of the vibratory separator 900 and/or the motion or vibration of the frame 901 may refer to the motion or vibration of the basket 905. Further, as shown, the vibratory separator 900 may include a plurality of force generators 907 coupled to the frame 901. As discussed above, the plurality of force generators 907 may provide vibratory motion to a screen assembly (not shown) disposed in the basket 905.

In one or more embodiments, the control unit 910 may be operatively connected to each of the plurality of force generators 907. The control unit 910 may be configured to independently control each of the plurality of force generators 907. For example, the control unit 910 may be configured to independently control a rotatable eccentric weight (not shown) in each of the plurality of force generators 907.

In one or more embodiments, controlling the rotatable eccentric weight in each of the plurality of force generators 907 may include controlling both the rate of rotation as well as the direction of rotation of the rotatable eccentric weight in each of the plurality of force generators. As such, in one or more embodiments, the control unit 910 may be configured to independently control a rate of rotation of the rotatable eccentric weight in each of the plurality of force generators 907. Further, in one or more embodiments, the control unit 910 may be configured to independently control a direction of rotation of the rotatable eccentric weight in each of the plurality of force generators 907.

For example, in one or more embodiments, the control unit 910 may control a first force generator, e.g., one of the plurality of force generators 907, and cause the first force generator to rotate in a first direction at a first rate of rotation, and the control unit 910 may simultaneously control a second force generator and cause the second force generator to rotate in a second direction at a second rate of rotation. Further, in one or more embodiments, the control unit 910 may also simultaneously control a third force generator and cause the third force generator to rotate in the first direction at a third rate of rotation. One having ordinary skill in the art will appreciate that the control unit 910 may independently control each force generator at various combinations of direction of rotation and rate of rotation, such that multiple force generators may be operated at the same or different directions of rotation or the same or different rates of rotation.

In one or more embodiments, the control unit 910 may be configured to control a motion profile of the frame through the independent control of each of the plurality of force sensors 907. In one or more embodiments, parameters of a motion profile of the frame 901 or of the vibratory separator 900 may include a frequency of motion or vibration of the frame 901, an amplitude of the motion or of the vibration of the frame 901, a phase or shape of the motion or vibration of the frame 901, and an angle of attack of the frame 901 based on the motion or vibration of the frame 901. Further, in one or more embodiments, the control unit 910 may be configured to store specific motion profiles. As such, in one or more embodiments, by independently controlling each of the plurality of force generators 907, the control unit 910 may allow each of the above-mentioned parameters to be changed independently without altering the other parameters, and numerous specific motion profiles to be achieved and stored. As will be discussed below, in one or more embodiments, the control unit 910 may include a programmable logic controller, which may be used to achieve motion profiles that may be stored or archived in the control unit 910.

In one or more embodiments, the frequency of motion of a body, such as the vibratory separator 900, the frame 901 of the vibratory separator 900, and/or the basket 905 of the vibratory separator, may refer to the rate of vibration of the body. For example, in one or more embodiments, a frequency of motion of the frame 901 may be said to increase if a rate of vibration of the frame 901 increases. In one or more embodiments, the amplitude of the motion of a body may refer to the magnitude, G-force, or overall displacement of the body during motion or vibration. For example, an amplitude of motion of the frame 901 may be said to increase if the displacement of the frame 901 increases. In one or more embodiments, the phase or shape of motion of a body may refer to a type of motion imparted on the body. For example, in one or more embodiments, the plurality of force generators may be controlled or manipulated to generate circular motion of the frame 901. Alternatively, in one or more embodiments, the plurality of force generators may be controlled or manipulated to generate elliptical motion of the frame 901. Further, in one or more embodiments, the plurality of force generators may be controlled or manipulated to generate thin-elliptical motion of the frame 901, or fat-elliptical motion of the frame 901, as well as any other shape. In one or more embodiments, the angle of attack of a body may refer to an angle of motion of the body relative to horizontal reference axis. For example, in one or more embodiments, the angle of attack of the frame 901 may be said to be 90 degrees if the motion of the frame 901 was a substantially vertical up-and-down motion. An angle of attack of 90 degrees may cause material disposed within the basket 905 of the vibratory separator 900 to bounce up and down. Conversely, an angle of attack of zero degrees may cause the frame 901 to shift back and forth in a substantially horizontal direction and may cause more of a sifting motion within the basket 905 of the vibratory separator 900. For example, a shallow angle of attack, e.g., an angle of attack that may be close to zero degrees, may be required to separate gumbo, whereas a higher angle of attack, e.g., an angle of attack that may be close to 90 degrees, may be used to separate discrete sand or shale. In one or more embodiments, the angle of attack, as well as the other parameters of the motion profile may be changed such that the vibratory separator 900 may become a "cuttings drier" during slow ROPO rock drilling, which may reduce fluid loss with cuttings and may reduce the amount of total waste generated.

In one or more embodiments, the independent control over each of the plurality of force generators 907 may also allow independent control over each of the parameters of a motion profile of the vibratory separator 900. As such, in one or more embodiments, being able to individually control a rate of rotation and direction of rotation of a rotatable eccentric weight (not shown) within each of the plurality of force generators 907 independently may allow each of the frequency of motion or vibration of the vibratory separator 900, an amplitude of the motion or of the vibration of the vibratory separator 900, a phase or shape of the motion or vibration of the vibratory separator 900, and an angle of attack of the frame 901 based on the motion or vibration of the vibratory separator 900 to be controlled independently of each other.

For example, in one or more embodiments, a user may use the control unit 910 to control each of the plurality of force generators 907 such that a shape or phase of the motion of the vibratory separator 900, or the frame 901 of the vibratory separator 900, may be changed without altering the frequency of the motion of the vibratory separator 900, the amplitude of the motion of the vibratory separator 900, or the angle of attack of the vibratory separator 900. Further, in one or more embodiments, a user may use the control unit 910 to control each of the plurality of force generators 907 such that the frequency of the motion of the vibratory separator 900 may be changed without altering any of the other parameters of the motion profile of the vibratory separator 900.

Furthermore, in one or more embodiments, a user may use the control unit 910 to control each of the plurality of force generators 907 such that two or three of the parameters of the motion profile of the vibratory separator 900 may be changed without altering the remaining parameters. For example, in one or more embodiments, a user may use the control unit 910 to control each of the plurality of force generators 907 such that both the amplitude of the motion of the vibratory separator 900 and the angle of attack of the vibratory separator 900 are changed without altering the frequency of the motion of the vibratory separator 900 or the phase or shape of the motion of the vibratory separator 900. Those having ordinary skill in the art will appreciate that, according to embodiments disclosed herein, any combination of parameters of the motion profile of the vibratory separator 900 described above may be independently changed or manipulated without altering the remaining parameters.

As such, according to one or more embodiments, a wide variation of controlled motion of the vibratory separator 900 may be achieved without dependence on mechanical phasing/synchronization or inertial phasing/synchronization. Further, in one or more embodiments, the number of force generators 907 as well as the location of each of the force generators 907 on the frame 901, as shown in FIGS. 1A-1B, 2A-2B, 3A-3B, 4A-4B, and 5A-5B, may also contribute to the types of motion profiles that may be achieved on the vibratory separator 900. In one or more embodiments, the number of force generators 907 may be increased in order to expand the scope of variation or control a user may have over the parameters of the motion profile of the vibratory separator 900.

Still referring to FIG. 9, in one or more embodiments, the control unit 910 may include a user interface 915, such as a digital control interface, to allow a user to select or input a motion profile. Specifically, in one or more embodiments, the user may use the user interface 915 to select or input a desired frequency of motion of the vibratory separator 900, an amplitude of the motion of the vibratory separator 900, a phase or shape of the motion of the of the vibratory separator 900, and/or an angle of attack of the vibratory separator 900 based on the motion of the vibratory separator 900. In one or more embodiments, the control unit 910 may allow a user to select or input a desired motion profile of the frame 901, or of the vibratory separator 900, as a whole or finely tune a current motion profile by controlling or manipulating each of the plurality of force generators 907 individually and independently. In one or more embodiments, the control unit 910 may allow a user to select or input a desired force output or rotational speed for each individual force generator 907. Those having ordinary skill in the art will appreciate that the motion of the vibratory separator 900 may refer to the vibration of the vibratory separator 900 or of the frame 901 induced by one or more of the plurality of force generators 907.

In one or more embodiments, the user interface 915 of the control unit 910 may be operatively connected to a system controller 916. In one or more embodiments, a power input 917 may be operatively connected to the system controller 916. Further, in one or more embodiments, a motor drive 918 may be operatively connected to each of the system controller 916 and the power input 917.

In one or more embodiments, the system controller 916 may include a processor and may function to translate inputs or instructions that may be input by a user through the user interface 915 to the motor drive 918, which may be configured to control each of the plurality of force generators 907 independently. In one or more embodiments, the motor drive 918 may be operatively connected to each of the plurality of force generators 907. As such, in one or more embodiments, the system controller 916 may allow a user to control the motion of each of the plurality of force generators 907 through the user interface 915.

In one or more embodiments, the user inputs or instructions to the plurality of force generators 907 may include vibratory motion protocols that define a pattern of movement for the vibratory separator 900. In one or more embodiments, the control unit 910 may provide instructions to modulate a power signal to at least one of the plurality of force generators 907. By changing the power signal, one of the force generators 907 may operate at a selected speed, thereby changing the resultant acceleration of the motion on vibratory separator 900 as a whole, including the frame 901 and the basket 905. In one or more embodiments, the power input 917 may provide power to the control unit 910 and may power both the system controller 916 and the motor drive 918.

Further, in one or more embodiments, the vibratory separator 900 may include one or more accelerometers 920 coupled to the frame 901. The accelerometers 920 may be used to detect and measure the current motion of the vibratory separator 900 at specific locations on the frame 901, e.g., at locations on the frame 901 at which the accelerometers 920 are coupled.

In one or more embodiments, each of the plurality of force generators may include one or more of the accelerometers 920. As such, in one or more embodiments, the accelerometers included in each of the force generators may be used to detect and measure the current motion of the vibratory separator 900 at different locations on the frame 901, e.g., at locations on the frame at which the force generators are coupled, as well as the overall motion profile of the vibratory separator 900. As discussed above, the motion profile of the vibratory separator may include a frequency of motion or vibration of the frame, an amplitude of the motion or of the vibration of the frame, a phase or shape of the motion or vibration of the frame, and an angle of attack of the frame based on the motion or vibration of the frame.

In one or more embodiments, the accelerometers 920 may be operatively connected to the control unit 910. In one or more embodiments, the accelerometers 920 may provide complex feedback regarding the motion of the vibratory separator 900 at various locations on the frame 901 to the control unit 910 in real time. As such, the system controller 916 may translate the feedback from the accelerometers 920 and may output these real time results to the user via the user interface 915. In response, the user may control or manipulate specific force generators 907 based on the feedback of specific accelerometers 920 in order to achieve a desired motion profile.

For example, during operation, the accelerometers 920 may provide feedback which may indicate that the overall vibration is decreasing in the vibratory separator 900. In one or more embodiments, this feedback may indicate to a user that there may be a potential increase or overload in the vibratory separator 900 if the conveyance of the material is also slowed.

Further, in one or more embodiments, the control unit 910 may include a programmable logic controller (not shown). In one or more embodiments, the programmable logic controller may include a closed feedback control loop that may allow the control unit 910 to control and independently manipulate each of the plurality of force generators 907 in real time to either change the motion profile of the frame 901 or to maintain a specific motion profile of the frame 901 under variable loads. In one or more embodiments, variable loads may include a load of material disposed in the vibratory separator 900, e.g., within the basket 905 of the vibratory separator 900, that changes over time. In other words, in one or more embodiments, variable loads may include a load of material disposed in the vibratory separator 900 that is changing in weight and/or volume over time.

In one or more embodiments, variable loads within the vibratory separator 900 may include unbalanced material loads within the vibratory separator 900. Unbalanced material loads may include a load of material unevenly disturbed within the vibratory separator 900 such that a vibration shape of the vibratory separator 900 is not uniform between a feed/inlet end and a discharge end of the vibratory separator 900, which may result in rocking of the vibratory separator 900.

In one or more embodiments, the programmable logic controller may include vibratory motion protocols that define a pattern of movement for the vibratory separator 900 based on specific feedback obtained by the programmable logic controller. In one or more embodiments, the accelerometers 920 may provide feedback to the programmable logic controller in real time and may cause the programmable logic controller to automatically control or manipulate one or more of the force generators 907 in line with one of the vibratory motion protocols in order to achieve a predetermined motion profile of the vibratory separator 900, e.g., motion profiles that may be stored or archived in the control unit 910.

Further, in one or more embodiments, the accelerometers 920 may be used to provide feedback to the control unit 910 regarding the type of load that is disposed within the vibratory separator 900. For example, a change to any of the parameters of a motion profile described above may indicate to a user that the amount of load and/or one or more characteristics of the load are changing. For example, a heaving load may require more force to vibrate, thus the programmable logic controller may instruct the force generators 907 to increase force output to maintain a predetermined motion profile. This may also indicate to the user what type of materials may be in the load, such as solids and/or liquids.

Thus, in one or more embodiments, the programmable logic controller and measurements taken from the accelerometers 920 may allow the control unit 910 to control each of the plurality of force generators 907 independently in real time to maintain a specific motion profile of the frame 901 when a load disposed within the frame 901 of the vibratory separator 900 is changing in weight and/or volume over time. As such, in one or more embodiments, the control unit 910 may be used to control each of the plurality of force generators 907 individually to maintain a constant motion profile of the frame 901 under a variable load, including unbalanced material loads. As such, rocking of the vibratory separator 900 may be mitigated or eliminated if the plurality of force generators 907 are controlled or manipulated to balance the unbalanced material load in the vibratory separator 900 in real time.

Further, in one or more embodiments, because there is a plurality of force generators 907 coupled to the vibratory separator 900, the vibratory separator 900 may continue to vibrate despite a failure of one or more of the force generators 907. For example, if a single force generator 907 fails, a user may selectively shut down other specific force generators 907, and the user may shift the motion profile of the vibratory separator 900 into a degraded mode. In one or more embodiments, a degraded mode may be a motion profile of the vibratory separator 900 with an acceptable, but reduced, amplitude or force. As such, even if one or more force generators 907 fail, a user may control the remaining operation force generators 907, e.g., manipulate the rate or rotation and/or direction of rotation of the rotatable eccentric weight of each of the operational force generators 907, to manipulate one or more parameters of the motion profile to generate a degraded motion profile. Alternatively, in one or more embodiments, the programmable logic controller may manipulate the remaining operational force generators 907 upon failure of one or more force generators 907 to automatically generate a degraded motion profile. In a degraded mode, fluid may be diverted to other vibratory separators (not shown) or the ROP may be reduced such that less material is being introduced into the vibratory separator 900.

In one or more embodiments, the motion profile may be a predetermined motion profile, which may be input into the control unit 901 by a user, e.g., via the user interface 915. As a result, in one or more embodiments, a user may manually adjust, or the programmable logic controller may automatically adjust and control each of the plurality of force generators 907 in order to achieve the desired motion profile of the frame 901 of the vibratory separator 900. Alternatively, in one or more embodiments, the programmable logic control may automatically adjust and control each of the plurality of force generators 907 in order to maintain one or more specific parameters of the motion profile of the frame 901, which may include a frequency of motion or vibration of the frame 901, an amplitude of the motion or of the vibration of the frame 901, a phase or shape of the motion or vibration of the frame 901, and an angle of attack of the frame 901 based on the motion or vibration of the frame 901.

For example, in one or more embodiments, the frequency, amplitude, and/or direction of rotation of one or more of the force generators 907 may be controlled or manipulated through the control unit 910. In one or more embodiments, by modulating the rotation of the rotatable eccentric weight of the force generators 907 from a first direction to a second direction, the shape of the motion imparted to vibratory separator 900 may be changed. Further, by increasing or decreasing the rate or rotation of the rotatable eccentric weight of the force generators 907, the frequency of motion of the vibratory separator 900 may be increased or decreased, respectively. Those of ordinary skill in the art will appreciate that design parameters of vibratory separators that may change a resultant motion produced include the force ratio of each actuator, the distance between the actuators, the angle of a platform relative to the screens, mass and inertia properties of the baskets, the angle of a mounting surface relative to the basket, and the placement of the force generators relative to the center of gravity of the vibratory separator.

In one or more embodiments, the use of the plurality of force generators 907, as opposed to a single force generator, may reduce the amount of stress imposed on the frame 901 of the vibratory separator 900. The stress imposed on the frame 901 may be reduced by increasing the number of force generators 907 coupled to the frame 901. In one or more embodiments, the locations at which the force generators 907 may also affect the amount of stress imposed on the frame 901 of the vibratory separator 900. In one or more embodiments, the force generators 907 may be used out of sync, which may minimize the vibration of the frame 901. As discussed above, the frame 901 of the vibratory separator 900 may include one or more side walls (not shown), a central wall (not shown), and/or a basket (not shown). Because the amount of stress imposed on the frame 901 may be reduced through the use of the plurality of force generators 907, a composite material may be used to form at least a portion of the basket and/or other portions of the frame 901. The composite material may be any substantially rigid material, including but not limited to metal, plastic, composite, and/or any combination thereof. Because less stress may be imposed on the frame 901 of the vibratory separator 900 through the use of the plurality of force generators 907, the material that forms the frame of the vibratory separator 900 may be lighter-weight material when compared to traditional materials that are used to form the frame of a vibratory separator.

Further, as discussed above, a user may have increased freedom in the position of each of the force generators on the vibratory separator. For example, in one or more embodiments, force generators may be coupled to opposite ends of a vibratory separator, without regard for the rigidity or flexibility of the connection between the force generators, and may still be able to achieve a desired motion profile of the vibratory separator.

Further, in one or more embodiments, the basket may be a split basket. In other words, the basket may include one main basket frame (not shown) and two or more deck portions (not shown) supported inside the main basket frame forming the split basket. In one or more embodiments, each portion of the split basket, which may be defined by the deck portions, may have independent motion profiles. In other words, each deck portion of the split basket may have independent frequency, amplitude, shape, and/or angle of attack. This may be achieved by coupling the force generators 907 to specific parts of the frame 901 in order to provide independent motion profiles for each deck portion of the split basket. Furthermore, in one or more embodiments, the vibratory separator 900 may include an independent scalping deck (not shown), which may be independent of the deck portions described above, and the independent scalping deck may have a motion profile that is independent of any of the deck portions.

In one or more embodiments, the vibratory separator 900 may include one or more moisture detection units (not shown). In one or more embodiments, the moisture detection units may include moisture sensors. The moisture detection units may be coupled to various locations on the vibratory separator 900, e.g., the frame 901, the basket 905, and/or on a screen assembly (not shown). In one or more embodiments, the moisture detection units may detect a moisture of reject solids from the input material and return this information as feedback to the control unit, e.g., to the programmable logic controller, to adjust the motion of the vibratory separator in response to the moisture data of the rejection solids. For example, in response to a high moisture content in the rejection solids, in one or more embodiments, the conveyance of material from the feed/inlet end to the output end of the vibratory separator 900 may be slowed down for liquid discharge and the angle of attack may be adjusted to a standing angle to avoid excess fluid loss.

According to another aspect, there is provided a method of controlling the vibration of a vibratory separator, the method including providing a vibratory separator having a frame, a plurality of force generators coupled to the frame, and a control unit operatively connected to each of the plurality of force generators, and independently controlling each of the plurality of force generators, in which independently controlling each of the plurality of force generators controls a motion profile of the vibratory separator.

As discussed above, the parameters of the motion profile of a vibratory separator may include a frequency of motion of the vibratory separator, an amplitude of motion of the vibratory separator, a phase or shape of motion of the vibratory separator, and an angle of attack of the vibratory separator. Further, as discussed above, any combination of parameters of the motion profile of the vibratory separator described above may be independently changed or manipulated without altering the remaining parameters. In one or more embodiments, this independent manipulation of the parameters of the motion profile of the vibratory separator may be achieved by controlling a plurality of force generators individually or independently.

Further, as discussed above, the plurality of force generators may include a rotatable eccentric weight. Referring back to FIG. 6B, the force generator 607 may include a rotatable eccentric weight 625. In one or more embodiments, the rotatable eccentric weight 625 may be formed from any material known in the art and may be configured to rotate in either direction, i.e., either clockwise or counterclockwise about an axis 650.

As discussed above, independently controlling each of the plurality of force generators may include independently controlling a rate of rotation of the rotatable eccentric weight of each of the plurality of force generators. Further, as discussed above, independently controlling each of the plurality of force generators may include independently controlling a direction of rotation of the rotatable eccentric weight of each of the plurality of force generators. Referring back to FIG. 6B, in one or more embodiments, the rotatable eccentric weight 625 may cause the force generator 607 to be unbalanced. As such, in one or more embodiments, the rotation of the rotatable eccentric weight 625 may produce a centripetal force, which may cause the force generator 607 to move or vibrate. In one or more embodiments, the frequency, amplitude, phase or shape, and angle of attack of the motion of the force generator 607 may be governed by the rate of rotation and the direction of rotation of the rotatable eccentric weight 625 of the force generator 607. As such, the parameters of a motion profile of a structure, which may include the frequency, amplitude, phase or shape, and angle of attack of the motion of a structure, e.g. a vibratory separator, may be governed by the rate of rotation and the direction of rotation of a rotatable eccentric weight, e.g., the rotatable eccentric weight 625, of one or more force generators, e.g., the force generator 607.

Furthermore, as discussed above, independently controlling each of the plurality of force generators may include automatically and independently controlling a rotation of the rotatable eccentric weight of each of the plurality of force generators with a programmable logic controller. Referring back to FIG. 9, in one or more embodiments, the programmable logic controller may include a closed feedback control loop that may allow the control unit 910 to control and independently manipulate each of the plurality of force generators 907 in real time to either change the motion profile of the frame 901 or to maintain a specific motion profile of the frame 901 under variable loads. Further, as discussed above, the programmable logic controller may manipulate the remaining operational force generators 907 upon failure of one or more force generators 907 to automatically generate a degraded motion profile such that the vibratory separator 900 still remains operational despite the failure of one or more force generators 907.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A vibratory separator apparatus comprising:

a frame;

a plurality of force generators coupled to the frame; and a control unit operatively connected to each of the plurality of force generators to independently control each of the plurality of force generators, the control unit configured to automatically control each of the plurality of force generators independently and in real-time to maintain a constant motion profile of the frame under a variable load.

2. The apparatus of claim 1, each of the plurality of force generators comprising a rotatable eccentric weight.

3. The apparatus of claim 1, wherein the control unit is configured to independently control a rate of rotation of the rotatable eccentric weight of each of the plurality of force generators.

4. The apparatus of claim 1, wherein the control unit is configured to independently control a direction of rotation of the rotatable eccentric weight of each of the plurality of force generators.

5. The apparatus of claim 1, wherein the control unit is configured to independently control a phase position of the rotatable eccentric weight of each of the plurality of force generators.

6. The apparatus of claim 2, wherein the control unit is configured to control a motion profile of the frame through the independent control of each of the plurality of force generators.

7. The apparatus of claim 6, wherein the motion profile of the frame includes at least one of a frequency, an amplitude, a phase, and an angle of attack of the frame.

8. The apparatus of claim 1, wherein the control unit comprises a programmable logic controller.

9. The apparatus of claim 8, wherein each of the plurality of force generators comprises an accelerometer.

10. The apparatus of claim 9, wherein the programmable logic controller is configured to automatically control each of the plurality of force generators based on a reading from the accelerometer of each of the plurality of force generators.

11. The apparatus of claim 1, the frame further comprising a central wall, wherein at least one of the plurality of force generators is coupled to the central wall.

12. The apparatus of claim 1, further comprising a screen assembly, wherein at least one of the plurality of force generators is coupled to the screen assembly.

13. A method of controlling the vibration of a vibratory separator, the method comprising:

providing a vibratory separator having a frame and a plurality of force generators coupled to the frame and a control unit operatively connected to each of the plurality of force generators; and independently controlling each of the plurality of force generators in real-time using a control unit, wherein independently controlling each of the plurality of force generators controls a motion profile of the vibratory separator, the independently controlling each of the plurality of force generators comprising independently controlling a speed of rotation of each of the plurality of force generators.

14. The method of claim 13, wherein the motion profile of the vibratory separator comprises at least one of a frequency, an amplitude, a phase, and an angle of attack of the vibratory separator.

15. The method of claim 13, wherein each of the plurality of force generators comprises a rotatable eccentric weight.

16. The method of claim 15, wherein independently controlling each of the plurality of force generators comprises independently controlling at least one of a phase position, and a direction of rotation of the rotatable eccentric weight of each of the plurality of force generators.

17. The method of claim 13, wherein independently controlling each of the plurality of force generators comprises automatically and independently controlling a rotation of the rotatable eccentric weight of each of the plurality of force generators with a programmable logic controller.

18. A method comprising:

vibrating a vibratory separator having a frame and a plurality of force generators coupled to the frame;

controlling a motion profile of the vibratory separator, the controlling comprising:

independently controlling a rotatable eccentric weight of each of the plurality of force generators instantaneously in response to feedback from a closed feedback control loop, including independently controlling a phase position, a rate of rotation, and a direction of rotation of the rotatable eccentric weight of each of the plurality of force generators.

19. The method of claim 18, wherein controlling the motion profile of the vibratory separator comprises controlling a control unit operatively connected to each of the plurality of force generators.

20. The method of claim 18, further comprising independently controlling parameters of the motion profile of the vibratory separator, the parameters comprising a frequency, an amplitude, and an angle of attack of the vibratory separator.

* * * * *